US007843183B2

(12) United States Patent
Al-Shyoukh et al.

(10) Patent No.: US 7,843,183 B2
(45) Date of Patent: Nov. 30, 2010

(54) REAL TIME CLOCK (RTC) VOLTAGE REGULATOR AND METHOD OF REGULATING AN RTC VOLTAGE

(75) Inventors: Mohammad A. Al-Shyoukh, Richardson, TX (US); Marcus M. Martins, Richardson, TX (US); Dircere Martins, legal representative, Richardson, TX (US)

(73) Assignee: Texas Instruments Incorporated, Dallas, TX (US)

( * ) Notice: Subject to any disclaimer, the term of this patent is extended or adjusted under 35 U.S.C. 154(b) by 355 days.

(21) Appl. No.: 11/961,945

(22) Filed: Dec. 20, 2007

(65) Prior Publication Data

US 2009/0160410 A1 Jun. 25, 2009

(51) Int. Cl.
*G05F 1/40* (2006.01)

(52) U.S. Cl. ..... 323/282

(58) Field of Classification Search ..... 323/282, 323/283, 285, 312–317; 713/500, 501
See application file for complete search history.

(56) References Cited

U.S. PATENT DOCUMENTS

| | | | | |
|---|---|---|---|---|
| 7,170,274 | B2 * | 1/2007 | Mukherjee et al. | 323/313 |
| 7,227,426 | B2 * | 6/2007 | Kaizuka | 331/186 |
| 7,516,339 | B2 * | 4/2009 | Gottlieb | 713/300 |
| 7,550,954 | B2 * | 6/2009 | De Nisi et al. | 323/266 |
| 2007/0278861 | A1 * | 12/2007 | Lou et al. | 307/66 |
| 2008/0104433 | A1 * | 5/2008 | May et al. | 713/300 |
| 2008/0178034 | A1 * | 7/2008 | Hirayama et al. | 713/501 |

* cited by examiner

*Primary Examiner*—Matthew V Nguyen
(74) *Attorney, Agent, or Firm*—John J. Patti; Wade J. Brady, III; Frederick J. Telecky, Jr.

(57) ABSTRACT

A real time clock (RTC) voltage regulator, a method of regulating an RTC voltage and a power management integrated circuit (PMIC). In one embodiment, an RTC voltage regulator includes a current source configured to provide a first current and a voltage regulator having a common gate amplifier and a power device. The first current is employed to establish a reference voltage for the common gate amplifier and the common gate amplifier is configured to control the power device. The power device is configured to provide an RTC voltage for the common gate amplifier.

14 Claims, 3 Drawing Sheets

REAL TIME CLOCK (RTC) VOLTAGE REGULATOR AND METHOD OF REGULATING AN RTC VOLTAGE

TECHNICAL FIELD OF THE INVENTION

The invention is directed, in general, to reducing power consumption when operating a real time clock (RTC) module and, more specifically, to an RTC voltage regulator on integrated circuits (ICs) of portable electronics that operates under reduced power.

BACKGROUND OF THE INVENTION

Battery powered devices, such as mobile telephones, typically include multiple modes of operation to conserve battery power. For example, a sleep mode is often employed when the device is not being used. In the sleep mode, certain components of the device remain activated at a minimum power. Of course, battery power can be conserved even more if the device is turned off. Nevertheless, even when the battery-powered device is turned-off, a RTC module is still needed for the device and normally remains powered on at a reduced power level that consumes little battery power.

Power management integrated circuits (PMICs) are often used to manage power consumption for battery-powered devices. PMICs provide the different voltage regulator rails needed to run the core and peripheral ICS in the portable device. In addition to being able to maintain low power consumption of the components in sleep mode, PMICs typically include an RTC voltage regulator that regulates down the battery voltage to provide a power rail for RTC circuitry low power crystal. RTC circuitry usually includes an ultra low power crystal oscillator and associated logic that is necessary to generate the RTC timing signals. The RTC voltage regulator is used to provide a reliable voltage source for the RTC circuitry even when the load of the RTC circuitry varies and even when the battery varies due to discharging. Because the RTC circuitry will require power to generate the RTC signals even when the handheld device is completely powered down, minimizing the amount of power needed to provide the RTC signals is desired.

Accordingly, what is needed in the art is an apparatus or system, capable of operating with ultra low levels of power consumption, for generating the power rail from which an RTC module can be powered.

SUMMARY OF THE INVENTION

To address the above-discussed deficiencies of the prior art, the invention provides an RTC voltage regulator, a method of regulating an RTC voltage and a power management integrated circuit (PMIC). In one embodiment, the RTC voltage regulator includes: (1) a current source configured to provide a first current and (2) a voltage regulator having a common gate amplifier and a power device. The first current is employed to establish a reference voltage for the common gate amplifier and the common gate amplifier is configured to control the power device. The power device is configured to provide an RTC voltage for the common gate amplifier.

In another aspect, the invention provides a method of regulating an RTC voltage. The method includes: (1) providing a first current from a current source, (2) establishing a reference voltage for a common gate amplifier employing the first current, (3) controlling a power device employing an output from the common gate amplifier and (4) employing the power device to regulate an RTC voltage at an input of the common gate amplifier.

In yet another aspect, the invention provides a power management integrated circuit (PMIC). In one embodiment the PMIC includes: (1) an input node configured to receive an operating voltage from a battery and (2) an RTC voltage regulator. The RTC voltage regulator includes: (2A) a current source configured to provide a first current employing the operating voltage and (2B) a voltage regulator having a common gate amplifier and a power device. The first current is employed to establish a reference voltage for the common gate amplifier and the common gate amplifier is configured to control the power device. The power device is configured to regulate an RTC voltage.

BRIEF DESCRIPTION OF THE DRAWINGS

For a more complete understanding of the invention, reference is now made to the following descriptions taken in conjunction with the accompanying drawings, in which.

DETAILED DESCRIPTION

Figure 1:
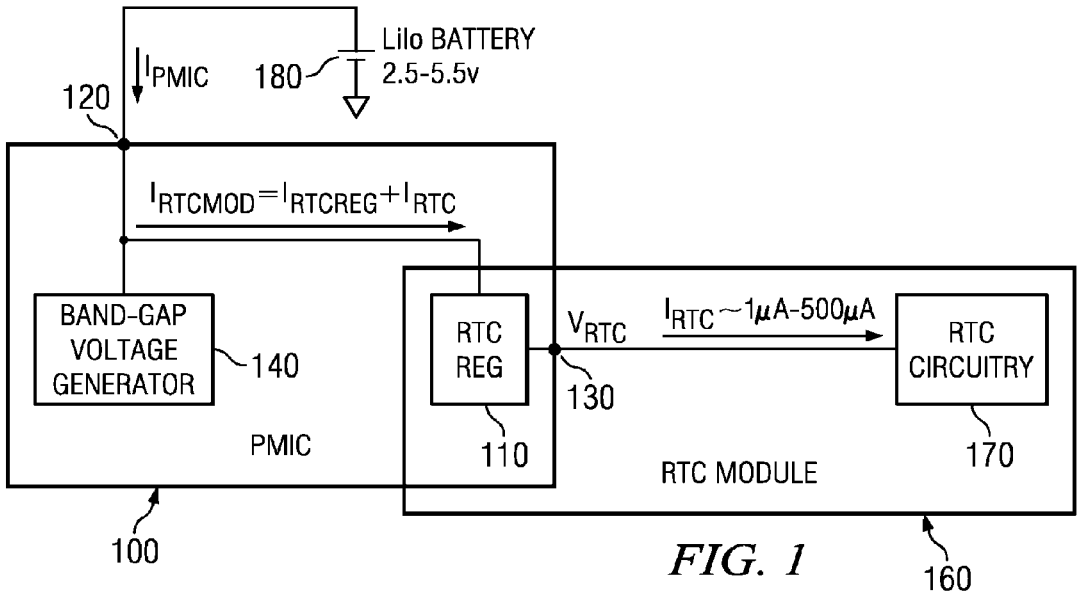
FIG. 1 illustrates a block diagram of an embodiment of a power management integrated circuit (PMIC) having a real time clock (RTC) voltage regulator constructed according to the principles of the invention.

FIG. 1 illustrates a block diagram of an embodiment of a PMIC 100 having an RTC voltage regulator 110 constructed according to the principles of the invention. The PMIC 100 is configured to provide power management for a handheld device in order to conserve power and extend the life of the handheld device's battery 180. The PMIC 100 may be fabricated using a CMOS process technology, such as, at 90 nm, 120 nm or 180 nm. In addition to the RTC voltage regulator 110, the PMIC 100 includes an input node 120, an output node 130 and a bandgap voltage generator 140. The input and output nodes, 120, 130, are conventional nodes that provide an electrical connection to and from the PMIC 100. The bandgap voltage generator 140 is also a conventional component that provides a designated bandgap voltage. For silicon-based bulk CMOS process technologies, the bandgap voltage will provide a voltage of (or approximately of) 1.2 volts. One skilled in the art will understand that the PMIC 100 may include several additional components that are typically included in a conventional PMIC.

The input node 120 is configured to receive an operating voltage from the battery 180. The battery 180 is a lithium ion (LiIo) battery commonly employed in handheld devices such as a mobile telephone or a personal digital assistant. The battery 180 provides an operating voltage from about 2.5 volts to about 5.5 volts. The operating voltage provided by the battery 180 will vary due to discharging. Other batteries or operating voltages may be used with the present invention.

The RTC voltage regulator 110 is coupled to RTC circuitry 170 via the output node 130 of the PMIC 100. Together, the RTC voltage regulator 110 and the RTC circuitry 170 compose an RTC module designated 160. As illustrated in FIG. 1, the RTC circuitry 170 is not located on the PMIC 100. In some embodiments, however, the PMIC 100 may include the RTC circuitry 170.

The RTC circuitry 170 includes an ultra-low power crystal oscillator and associated logic to provide an RTC clock signal for the device. Typically, the oscillator operates at approximately 32 kHz and draws a current of approximately 1 μA. The load requirements for the RTC circuitry 170, however, can vary and may approach hundreds of microamps (μA) under heavy loading conditions.

The RTC voltage regulator 110 uses the operating voltage from the battery 180 to provide an RTC voltage rail, $V_{RTC}$, at the output node 130 for the RTC circuitry 170. The RTC voltage may be, for example, 1.8 volts, 1.5 volts or 1.2 volts, or any other volts as demanded by the voltage rating of the digital CMOS process technology employed in fabricating the RTC circuitry 170. In some embodiments, the RTC voltage regulator 110 is coupled to the bandgap voltage generator 140 and is configured to provide the RTC voltage based on scaling of the bandgap voltage. This particular embodiment of the RTC voltage regulator 110 is discussed in more detail with respect to FIG. 4. In other embodiments, the RTC voltage regulator 110 is not integrated into the bandgap voltage generator 140 and is configured to provide an RTC output voltage equal to the bandgap voltage at 1.2 volts. This particular embodiment of the RTC voltage regulator 110 is discussed in more detail with respect to FIG. 5.

As noted above, the PMIC 100 manages power consumption in the portable device and aims at extending the life of the battery 180. The PMIC 100 draws a current $I_{PMIC}$ as indicated in FIG. 1. $I_{PMIC}$ will vary according to the mode of operation of the device. During sleep mode, for example, $I_{PMIC}$ includes the load current $I_{SLEEP}$ and the load current $I_{RTCMOD}$. $I_{SLEEP}$ (not illustrated) represents the current required to maintain designated components during the sleep mode. $I_{RTCMOD}$ represents the current required by the RTC module 160. When the device is turned off, $I_{PMIC}$ no longer includes $I_{SLEEP}$. Regardless of the mode of operation, however, $I_{PMIC}$ will include $I_{RTCMOD}$ because the RTC module 160 remains on to provide an RTC voltage rail.

$I_{RTCMOD}$ includes $I_{RTC}$ and $I_{RTCREG}$. $I_{RTC}$ represents the current consumed by the RTC circuitry 170 and $I_{RTCREG}$ represents the quiescent current of the RTC voltage regulator 110. As noted above, the required current for the RTC circuitry 170 is dynamic and may range from a microamp to several hundreds microamps. In order to provide $V_{RTC}$ as needed and to respond to the dynamic changing load of the RTC circuitry 170, the operating circuitry requires current. For example, current is required to operate transistors to regulate a voltage supply for a changing load. Accordingly, to minimize the power/current consumed in the RTC regulator $I_{RTCREG}$, the RTC voltage regulator 110 is designed such that the more-power-consuming dynamic circuitry that responds to changes of $I_{RTC}$ is minimized.

Figure 2:
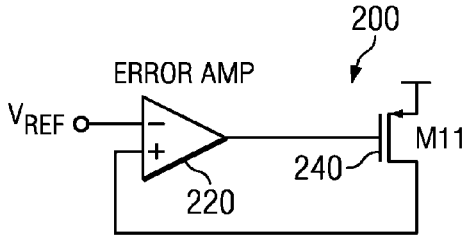
FIG. 2 illustrates a schematic diagram representing a voltage regulator.

For example, turning briefly to FIG. 2, illustrated is a schematic diagram representing an embodiment of a voltage regulator 200 that may be used in existing RTC voltage regulators. The voltage regulator 200 includes an error amplifier 220 and a power device 240. The operation and configuration of the voltage regulator 200 is well known to one skilled in the art. The error amplifier 220 is a conventional error amplifier that receives two inputs and adjusts the gate control of the power device 240 to keep the inputs of the amplifier 220 equal. A reference voltage is received at a first input, a negative input, and a feedback voltage from the power device 240 is received at a second input, a positive input. The power device 240 is a conventional PMOS transistor that operates as a pass device. Other types of transistors (P-type power DMOS, or drain extended PMOS) could also be employed as the pass device. The output generated by the error amplifier 220 is used to drive (i.e., control) the power device 240 while the feedback voltage is looped back to the second input. The feedback loop ensures that the output voltage $V_{RTC}$ is equal to the reference $V_{REF}$ for the various loading conditions. $V_{DD}$ represents an operating supply voltage for the voltage regulator 200. The operating voltage can be provided by a battery such as a Lithium-Ion battery.

The error amplifier 220 includes multiple transistors that operate to continually adjust the gate bias of the power device in an attempt to equate the first and second inputs (the reference voltage and the feedback voltage). The parts of the circuit that responds to the dynamic load changes and drives the pass device 240 require more quiescent current consumption than the other parts of the circuit. A higher current is normally required in the dynamic part of the circuitry both to ensure faster slewing of the gate control of pass device 240, as well as higher small signal bandwidth of the of the regulation feedback loop. The present invention provides RTC voltage regulators employing a minimum number of active components that respond to the dynamic loads of RTC circuitry ensuring reduced overall power consumption in the RTC regulator. More details of such RTC voltage regulators are provided with respect to FIGS. 3, 4 and 5.

Figure 3:
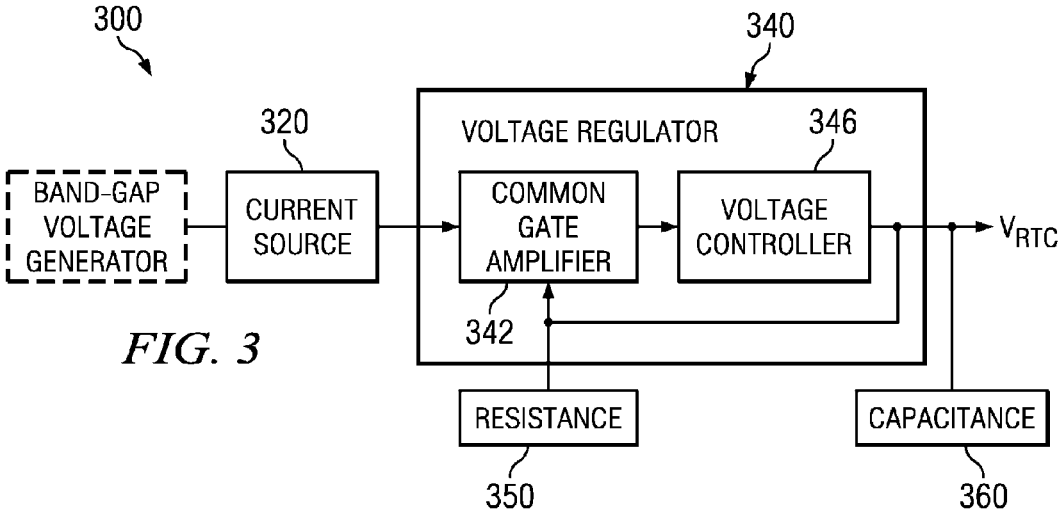
FIG. 3 illustrates a block diagram of an embodiment of an RTC voltage regulator constructed according to the principles of the invention.

FIG. 3 illustrates a block diagram of an embodiment of an RTC voltage regulator 300 constructed according to the principles of the invention. The RTC voltage regulator 300 includes a current source 320 and a voltage regulator 340. The current source 320 provides currents that pass through a common gate amplifier 342 of the voltage regulator 340 and resistance 350 coupled to the common gate amplifier 342 to generate a reference voltage and an RTC voltage at inputs (not illustrated) for the common gate amplifier 342. The common gate amplifier 342 operates to keep the reference voltage and the RTC voltage equal by controlling (i.e., turning-on and turning-off or activating and de-activating) a power device 346 of the voltage regulator 340. More detail of the common gate amplifier 342 is provided in FIGS. 4 and 5. The power device 346 is coupled to the common gate amplifier 342 to provide a feedback loop that is used in regulating the RTC voltage. The power device 346 is a PMOS transistor that operates as a pass device. Other types of transistors (P-type power DMOS, or drain extended PMOS) could also be employed as the power device 346.

The current source 320 and the voltage regulator 340 are coupled to a voltage source, such as a battery, that provides an operating voltage. The voltage source, for example, may be a LiIo battery as discussed with respect to FIG. 1. In some embodiments, the current source 320 may also be coupled to (derived from) a bandgap voltage generator as illustrated. In these embodiments, the current source 320 in-conjunction with resistance 350 create a scaled version of the reference voltage $V_{REF}$. The RTC output voltage $V_{RTC}$ is then regulated to be equal to this scaled $V_{REF}$ value. As such, the reference voltage $V_{REF}$ and the RTC voltage $V_{RTC}$ will be different from the bandgap voltage, typically at 1.2V. For example, if the desired value of the RTC output voltage $V_{RTC}$ is 1.8V, a 1.8V reference voltage is derived from the bandgap voltage of 1.2V. The current source 320 and the resistance 350 serve the purpose of scaling the bandgap voltage into the desired reference voltage $V_{REF}$ value required by the application.

The RTC voltage regulator 300 also includes a capacitance 360 that is coupled to the output of the power device 346. Because the load of RTC circuitry may vary, the capacitance 360 can provide additional power/current suddenly demanded by load while support for slower load changes is accomplished with the regulator's active circuitry which maintains the RTC voltage at the desired value. The capacitance 360 may be a capacitor that is sized based on known loads of the RTC circuitry. In some embodiments, the capacitance 360 may not be used, specifically when the load current variations as demonstrated by the RTC module are not that high.

Figure 4:
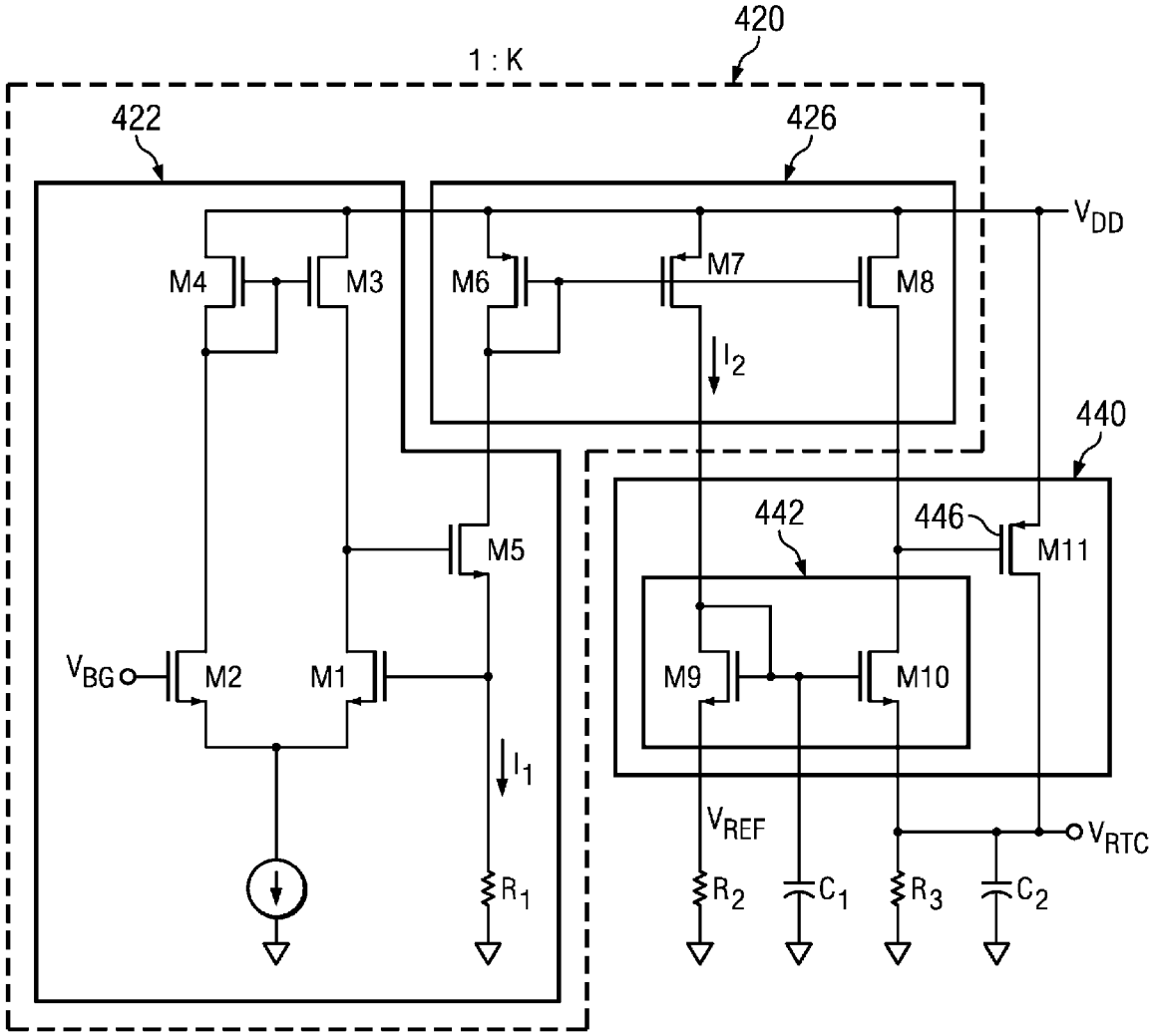
FIG. 4 illustrates a schematic diagram of an embodiment of an RTC voltage regulator constructed according to the principles of the invention.

FIG. 4 illustrates a schematic diagram of an embodiment of an RTC voltage regulator 400 constructed according to the principles of the invention. The RTC voltage regulator 400 includes a current source 420 and a voltage regulator 440. Both the current source 420 and the voltage regulator 440 are coupled to an operating voltage $V_{DD}$. The operating voltage may be provided by a battery such as a LiIo battery. The voltage regulator 440 includes a common gate amplifier 442 and a power device 446.

The current source 420 is configured to provide a first current based on a bandgap voltage. The current source 420 includes a voltage mode amplifier 422 and a current mirror 426. The voltage mode amplifier 422 realized by ($I_1$, $M_1$, $M_2$, $M_3$ and $M_4$) includes multiple transistors, denoted M1, M2, M3, M4 and M5 in FIG. 4, coupled together to generate the first current across a resistance represented by R1. A bandgap voltage is fed to the gate of M2 which in turn gets recreated at the gate of M1 thereby generating a first current $I_1$ having a value of $V_{BG}$/R1 A. The bandgap voltage may be provided by a separate bandgap voltage generator as illustrated in FIGS. 1 and 3.

The current mirror 426 includes transistor M6, M7 and M8 coupled together at each gate. The current mirror 426 generates a second current $I_2$ based on the first current. The second current has a value of $k\cdot(V_{BG}/R1)$ where k is a multiplication factor associated with the current mirror 426. In FIG. 4, k is one. In other embodiments, k may be greater than one resulting in the second current being greater than the first current. Alternatively the scaling k can be applied only to M8 because the current flowing through M8 goes to the dynamic part of the circuit (M10, M11) which responds to the load changes. If the bandgap voltage is stable with respect to temperature, then the reference voltage should also be temperature-stable because the reference voltage is dependent on the ratio R2/R1 and not an absolute value of a resistance.

The voltage regulator 440 includes a common gate amplifier 442 and a power device 446. The common gate amplifier includes a first transistor M9 and second transistor M10. In this embodiment, the first and second transistors are NMOS transistors. Both the first and second transistors are coupled to the current mirror 426. Also coupled to the first transistor is a resistance R2. The second current passes through the resistance R2 and generates a reference voltage $V_{REF}$ for the common gate amplifier 442. The second transistor is coupled to another resistance R3. Current passing through the resistance R3 generates the RTC voltage $V_{RTC}$ at the output. The resistance R3 may be sized such that part of the current flowing in R3 comes from M10 while the other part comes from pass device 446 (M11).

The power device 446 is a PMOS transistor that operates as a pass device. In other embodiments, the power device 446 may be another type of transistor (e.g. DEPMOS or PDMOS) if available in the process technology. The power device 446 is coupled to the second transistor of the common gate amplifier 442 to form a feedback loop. The feedback loop is used by the second transistor to keep the RTC voltage equal to the reference voltage. The second transistor controls the power device 446 (adjusts the gain) in an attempt to maintain the reference voltage and the RTC voltage at the same voltage. Thus, the RTC voltage regulator 400 includes a minimum number of components, namely the second transistor M10 in addition to the power device 446, that react to the dynamic changes of an RTC circuitry load. Accordingly, the RTC voltage regulator 400 will typically require less power than conventional RTC voltage regulators to provide the needed RTC voltage rail.

A capacitance C1 is coupled to the gates of the first and second transistors of the common gate amplifier 442. The capacitance C1 is coupled to the common gate of the first and second transistors to stabilize a gate voltage for the second transistor M10. Another capacitance C2 is coupled to the second input to provide power support for the RTC circuitry load when needed during fast load switching.

Figure 5:
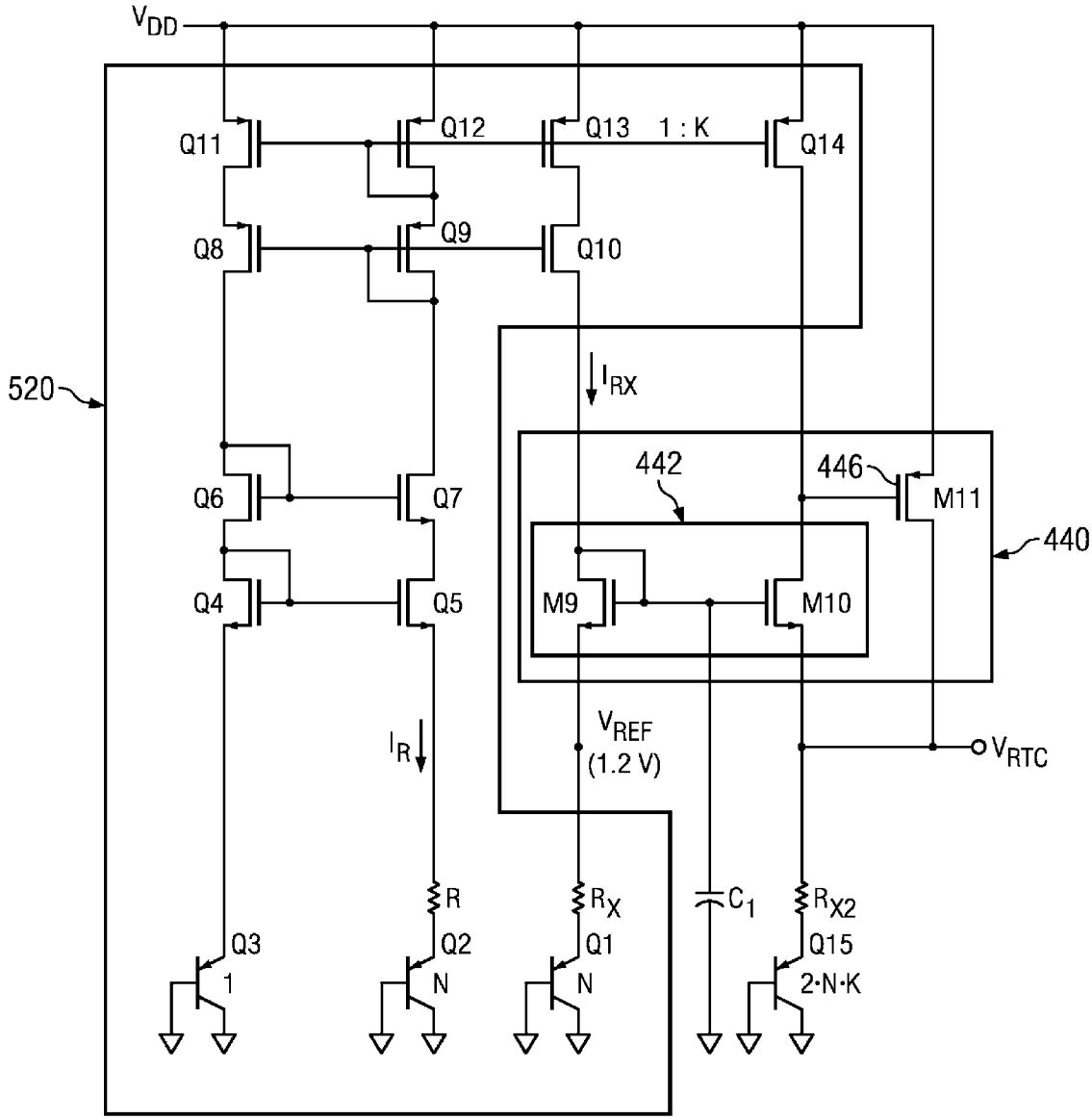
FIG. 5 illustrates a schematic diagram of another embodiment of an RTC voltage regulator constructed according to the principles of the invention.

FIG. 5 illustrates a schematic diagram of another embodiment of an RTC voltage regulator 500 constructed according to the principles of the invention. In this embodiment the RTC voltage regulator 500 is integrated in with a commonly used bandgap reference circuit to provide a non-scaled RTC voltage regulator where the output voltage VRTC is equal to the bandgap voltage (e.g., 1.2 volts). The RTC voltage regulator 500 includes a proportional-to-absolute-temperature (PTAT) current source 520 and a voltage regulator 440. Both the current source 520 and the voltage regulator 440 are coupled to an operating voltage $V_{DD}$. The current source 520 also generally comprises transistors Q1 through Q14

The current source 520 provides a PTAT current. More information on this type of current source can be found for example in "*Analysis and Design of Analog Integrated Circuits,*" 3rd Edition, pp 344-346, John Wiley and Sons, by Paul R. Gray and Robert G. Meyer ("Gray"). Briefly, the PTAT current $I_R$ is generated here by realizing the difference in base emitter voltage of a deliberately mismatched PNP pair Q2 and Q3 (N:1 emitter area ratio) over a resistor R. If the PTAT current $I_R$ is mirrored to generate current $I_{RX}$, which, in turn, is applied to a PNP transistor Q1 in series with a resistance $R_X$ so as to develop a temperature-independent bandgap reference voltage $V_{REF}$ of 1.2 volts. More information on the sizing of $R_X$ that would result in developing a bandgap voltage of 1.2 volts is also discussed in Gray.

In this embodiment the common gate amplifier 442 is coupled to the PTAT current generator 520 such that the bandgap reference voltage $V_{REF}$ acts as the reference voltage coupled to the source of the first transistor M9 in the amplifier 442. Transistor Q14 is included to mirror the same PTAT current $I_{RX}$ into the second transistor M10 of the common gate amplifier 442. Once more, and because the second transistor M10 in the common gate amplifier 442 is part of the dynamic circuitry which responds to load changes, scaling of the original PTAT current $I_{RX}$ can be employed such that the current through transistor Q14 is equal to $K\cdot I_{RX}$.

A resistor $R_{X2}$ in series with a PNP transistor Q15 is also coupled to the source of the second transistor M10 in the common gate amplifier 442. The size of this resistor $R_{X2}$ can be chosen as $(R_X/2\cdot K)$ while the PNP transistor Q15 emitter area can be chosen as $2\cdot N\cdot K$. This would result in a current of $K\cdot I_{RX}$ flowing into pass device 446. The combination of the two currents flowing in mirror transistor Q14 and, in turn, flowing into the second transistor M10 of the common gate amplifier 442 in addition to the current flowing in pass device 446 results in an output voltage $V_{RTC}$ that is equal to $V_{REF}$, which in this embodiment is always equal to the bandgap voltage of 1.2 volts. In spite of this limitation, this voltage is a suitable voltage rail level for various types of loads specifically on finer feature size process technologies (e.g. 90 nm, 65 nm, 45 nm). The advantage here however is that the RTC regulator, and the bandgap reference are integrated in an all-in-one configuration which can be beneficial both from a silicon die area and cost perspective along with a power consumption perspective.

Those skilled in the art to which the invention relates will appreciate that other and further additions, deletions, substitutions and modifications may be made to the described embodiments without departing from the scope of the invention.

What is claimed is:

1. A real time clock (RTC) voltage regulator comprising:

a current source that provides a first current; and a voltage regulator having:

a common gate amplifier having first and second MOS transistors, wherein each of the first and second MOS transistors is coupled to the current source, and wherein the first MOS transistors receives the first current, and wherein the first current establishes a reference voltage for the common gate amplifier;

a power device that is coupled to the second MOS transistor and that is controlled by the common gate amplifier, wherein the power device provides an RTC voltage for the common gate amplifier.

2. The RTC voltage regulator of claim 1, wherein the current source further comprises a voltage-mode amplifier that provides the first current based at least in part on a bandgap voltage.

3. The RTC voltage regulator of claim 2, wherein the current source further comprises a current mirror that is coupled to the current mode amplifier and the second MOS transistor, wherein the current mirror provides a second current based at least in part on the first current, and wherein the second current is employed to establish the reference voltage for the common gate amplifier.

4. The RTC voltage regulator of claim 1, wherein the current source further comprises a proportional-to-absolute-temperature (PTAT) current source circuit to provide the first current.

5. The RTC voltage regulator of claim 1, wherein the first MOS transistor is diode-connected and the second MOS transistor is coupled to the gate of the first MOS transistor at its gate.

6. The RTC voltage regulator of claim 5, further comprising a capacitor that is coupled to the gates of the first and second MOS transistors.

7. A power management integrated circuit (PMIC) comprising:

an input node configured to receive an operating voltage from a battery; and a real time clock (RTC) voltage regulator including:

a current source that provides a first current; and a voltage regulator having:

a common gate amplifier having first and second MOS transistors, wherein each of the first and second MOS transistors is coupled to the current source, and wherein the first MOS transistors receives the first current, and wherein the first current establishes a reference voltage for the common gate amplifier;

a power device that is coupled to the second MOS transistor and that is controlled by the common gate amplifier, wherein the power device provides an RTC voltage for the common gate amplifier.

8. The PMIC of claim 7, wherein the current source further comprises a voltage-mode amplifier that provides the first current based at least in part on a bandgap voltage.

9. The PMIC of claim 8, wherein the current source further comprises a current mirror that is coupled to the current mode amplifier and the second MOS transistor, wherein the current mirror provides a second current based at least in part on the first current, and wherein the second current is employed to establish the reference voltage for the common gate amplifier.

10. The PMIC of claim 7, wherein the first MOS transistor is diode-connected and the second MOS transistor is coupled to the gate of the first MOS transistor at its gate.

11. The PMIC of claim 10, further comprising a capacitor that is coupled to the gates of the first and second MOS transistors.

12. An apparatus comprising:

a bandgap voltage generator; and a real time clock (RTC) voltage regulator having:

a current source that is coupled to the bandgap voltage source;

a first MOS transistor that is coupled to the current source at its gate and its drain, wherein the first MOS transistor is diode-connected;

a second MOS transistor that is coupled to the gate of the first MOS transistor at its gate and the current source at its drain; and a third MOS transistor that is coupled to the drain of the second MOS transistor at its gate and that outputs a reference voltage at its drain.

13. The apparatus of claim 12, wherein the current source further comprises:

a voltage-mode amplifier that is coupled to the bandgap voltage generator; and a current mirror that is coupled to the voltage-mode amplifier and the drains of the first and second MOS transistors.

14. The apparatus of claim 13, wherein the voltage-mode amplifier further comprises:

a differential amplifier having a first input terminal, a second input terminal, and an output terminal, wherein the first input terminal of the differential amplifier is coupled to the bandgap voltage generator;

a fourth MOS transistor that is coupled to the output terminal of the differential amplifier at its gate, that is coupled to the second input terminal of the differential amplifier at its source, and that is coupled to the current mirror at its drain; and a resistor that is coupled to the source of the fourth MOS transistor.

* * * * *